US011273559B2

(12) United States Patent
McRorie, III

(10) Patent No.: US 11,273,559 B2
(45) Date of Patent: Mar. 15, 2022

(54) BIT RETENTION MECHANISM

(71) Applicant: Veiss Gear, LLC, Huntersville, NC (US)

(72) Inventor: Robert Grant McRorie, III, Huntersville, NC (US)

(73) Assignee: Veiss Innovation, LLC, Huntersville, NC (US)

( * ) Notice: Subject to any disclaimer, the term of this patent is extended or adjusted under 35 U.S.C. 154(b) by 0 days.

(21) Appl. No.: 16/274,762

(22) Filed: Feb. 13, 2019

(65) Prior Publication Data

US 2019/0248032 A1 Aug. 15, 2019

Related U.S. Application Data

(60) Provisional application No. 62/629,823, filed on Feb. 13, 2018.

(51) Int. Cl.

| | |
|---|---|
| ***B26B 5/00*** | (2006.01) |
| ***B26B 1/10*** | (2006.01) |
| *B26B 21/40* | (2006.01) |

(52) U.S. Cl.

CPC ..... *B26B 5/003* (2013.01); *B26B 1/10* (2013.01); *B26B 21/4025* (2013.01); *B26B 21/4037* (2013.01)

(58) Field of Classification Search

CPC ..... B26B 5/001; B26B 5/002; B26B 5/003; B26B 21/4037

USPC ..... 30/162

See application file for complete search history.

(56) References Cited

U.S. PATENT DOCUMENTS

| | | | | | |
|---|---|---|---|---|---|
| 158,830 | A * | 1/1875 | Buterwork | B26B 5/006 | 30/320 |
| 164,336 | A * | 6/1875 | George | B26B 27/00 | 30/290 |
| 253,185 | A * | 2/1882 | Christlmiller | B26B 5/006 | 30/320 |
| 4,817,284 | A * | 4/1989 | Sacherman | B26B 5/00 | 30/329 |
| 4,868,985 | A * | 9/1989 | Rehm | B26B 5/003 | 30/162 |
| 5,391,177 | A * | 2/1995 | Schwartz | A61B 17/3211 | 30/151 |
| 6,796,033 | B2 * | 9/2004 | Owoc | B26B 5/001 | 30/162 |
| 8,943,700 | B2 * | 2/2015 | Cetola | A61B 17/3213 | 30/162 |
| 2006/0048392 | A1 * | 3/2006 | Okada | B26B 5/002 | 30/162 |

(Continued)

FOREIGN PATENT DOCUMENTS

| | | | | |
|---|---|---|---|---|
| DE | 3744456 | A1 * | 7/1988 | B26B 5/003 |
| FR | 2505240 | A1 * | 11/1982 | B26B 5/002 |
| GB | 2085790 | A * | 5/1982 | B26B 5/001 |

*Primary Examiner* — Jennifer S Matthews

(74) *Attorney, Agent, or Firm* — Trego, Hines & Ladenheim, PLLC

(57) ABSTRACT

A blade retention mechanism that includes a body and a catch. The catch is configured to engage a bit. A knurled nut is configured to engage the catch and the body such that it is movable. When the nut is moved between a first position and a second position the catch moves between a first position and a second position. A v-groove is formed in the body and is configured to receive and retain a bit when the catch is in the first position.

12 Claims, 15 Drawing Sheets

(56) References Cited

U.S. PATENT DOCUMENTS

| | | | | |
|---|---|---|---|---|
| 2007/0261174 | A1* | 11/2007 | Barker | B26B 5/00 7/160 |
| 2018/0001489 | A1* | 1/2018 | Scimone | B26B 5/00 |

* cited by examiner

FIG. 17
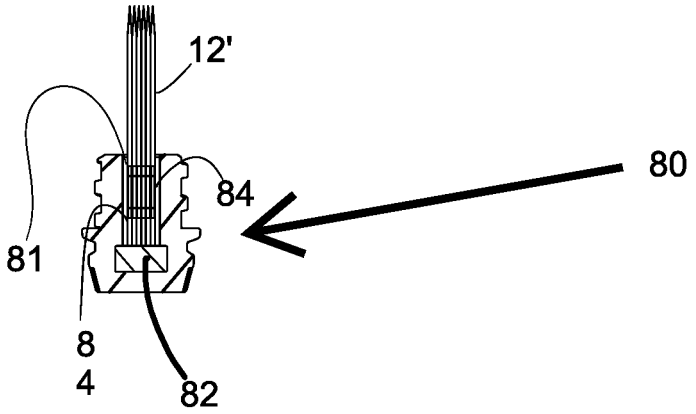
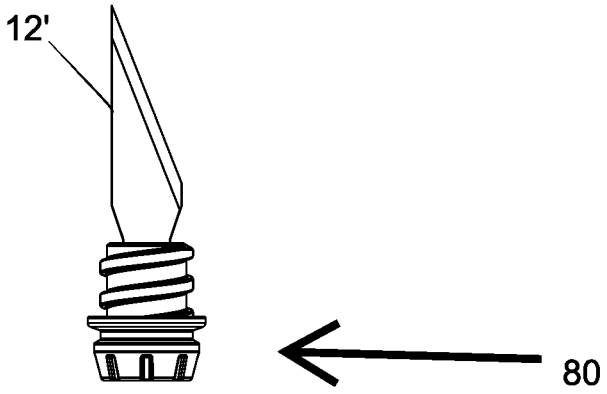
FIG. 18

BIT RETENTION MECHANISM

BACKGROUND OF THE INVENTION

This invention relates generally to a retention mechanism for a tool bit and more specifically to a retention mechanism that secures a blade or other type tool bit to a craft knife.

Tools such as craft knives utilize interchangeable bits or blades. Specifically, replaceable blades are used in craft knives to perform careful and precise cutting. Craft knives are used by those in the design industry and by others for crafts, albums, and the like. Typically blades in craft knives are retained by a collet.

One problem with retention by a collet is that the-collet will loosen while using the knife, thereby allowing the blade to loosen and slip out. This is especially true when the knife is twisted while cutting on a curve.

Another problem is that retention devices of conventional craft knives are not configured to retain the blade such that it is positioned solidly side-to-side even when the collet is firmly tightened.

SUMMARY OF THE INVENTION

The present invention addresses these and other problems by providing a handle for receiving interchangeable blades and tool bits. The handle is configured to receive the blade such that tension is applied to the blade. In this regard, the handle includes a retention mechanism that is configured to engage the shoulders of the blade at one end of the mechanism and apply tension to the blade shank at the other and of the mechanism.

BRIEF DESCRIPTION OF THE DRAWINGS

The invention may be best understood by reference to the following description taken in conjunction with the accompanying drawing figures in which:

FIG. 17 shows a sectional view of an end cap configured for retention of spare blades and spare blades;

FIG. 18 shows a side view of the end of FIG. 17;

DETAILED DESCRIPTION OF THE INVENTION

Figure 1:
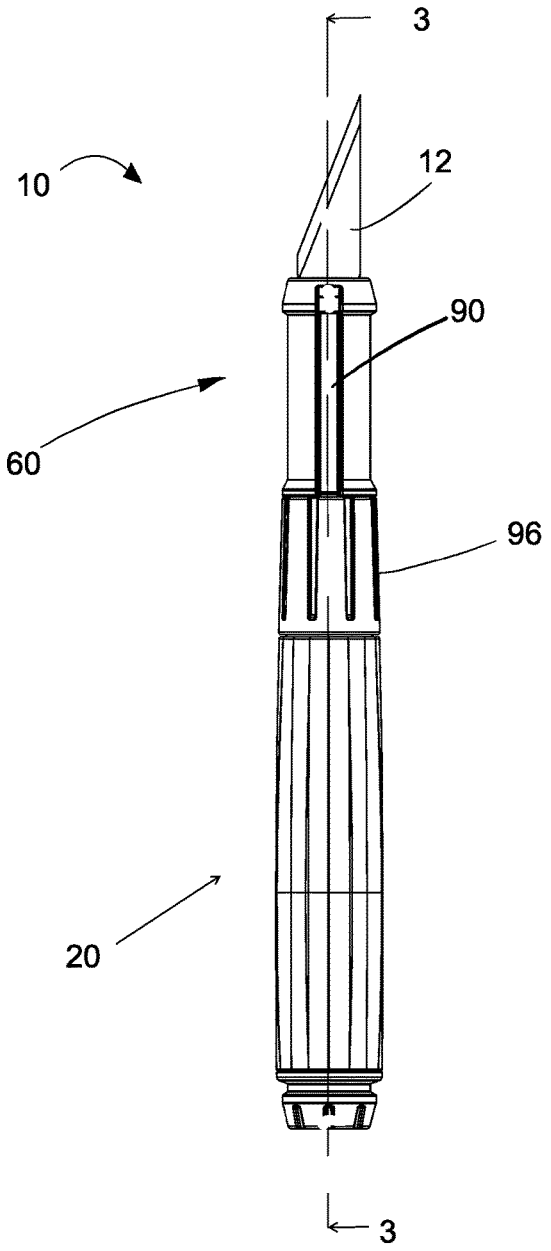
FIG. 1 shows a side view of a tool that includes a bit retention mechanism according to the present invention.
Figure 2:
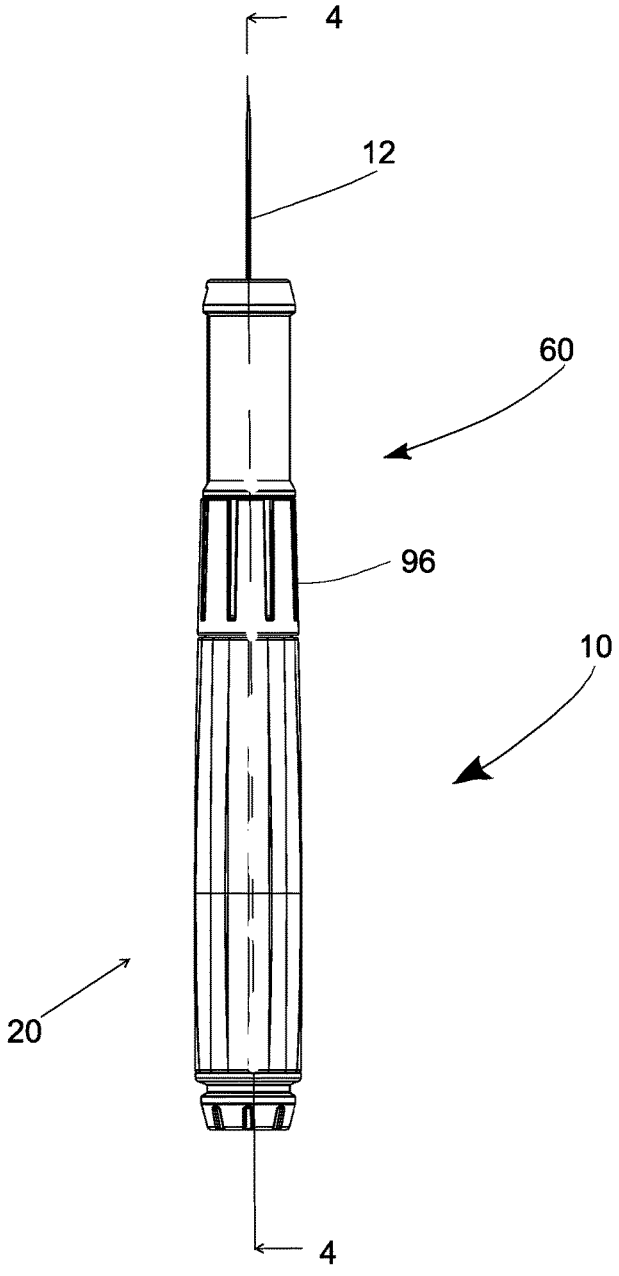
FIG. 2 shows another side view of the tool of FIG. 1.

The technology disclosed herein provides a retention mechanism for retaining a bit in a handle. As shown in FIGS. 1 and 2, there is provided a craft knife 10 that includes a retention mechanism 60 for a blade 12. It should be appreciated that the blade 12 is a bit and that the knife 10 could be other kinds of tools with other types of bits. The craft knife 10 also includes a handle 20. The knife 10 includes a catch 90 that is configured to engage a hole 19 formed in blade 12. The catch 90 is configured to move in response to the operation of nut 96 between an open position in the closed position and a dog leg path such that portions of the catch 90 is described below are configured to position the blade 12 such that it can be drawn into the bit retention mechanism 60 as the catch 90 is moved from the open position to the closed position. When the catch 90 is in the closed position the blade 12 is secured within the bit retention mechanism 60 such that the blade 12 has less side to side motion relative to the handle 20 than conventional tools such as craft knives.

Figure 3:
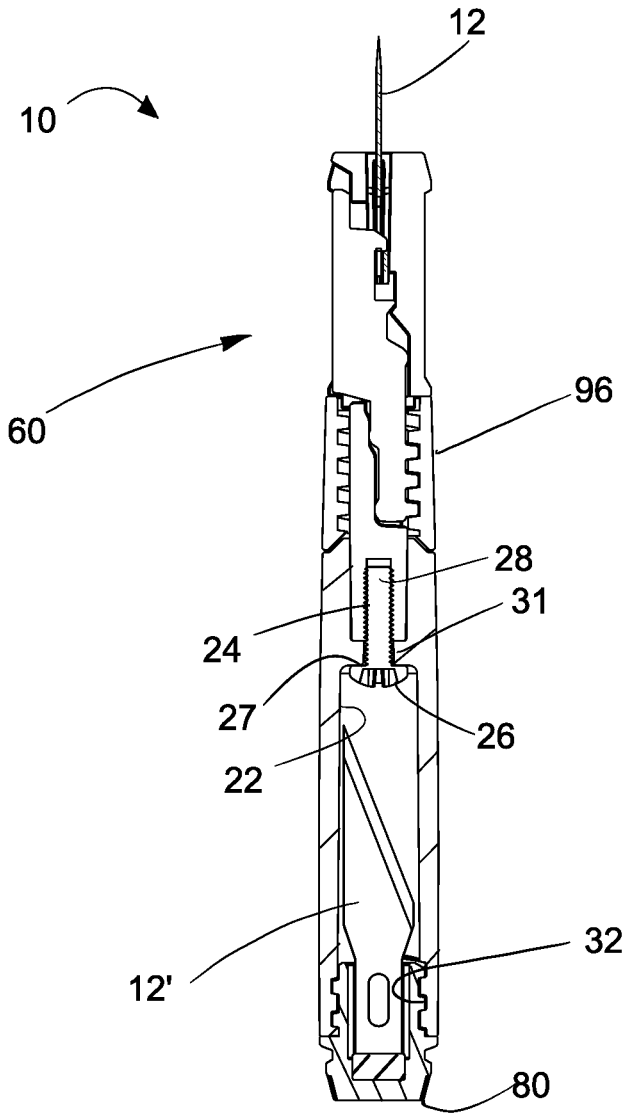
FIG. 3 shows a cross-sectional view of the tool of FIG. 1 taken along line 3-3 with the bit mechanism in a retention configuration.
Figure 4:
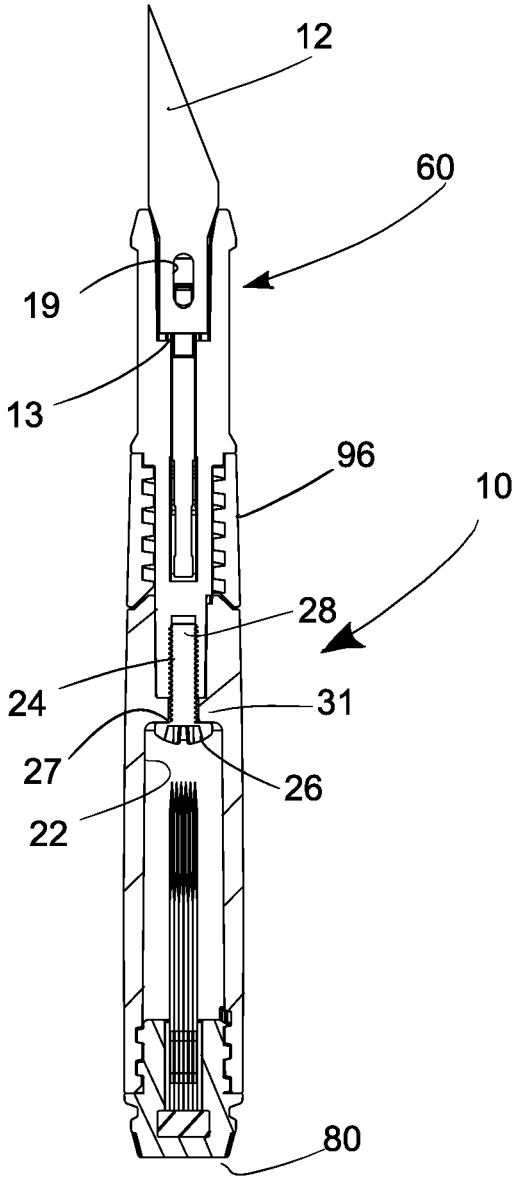
FIG. 4 shows a cross-sectional view of the total of FIG. 2 taken along line 4-4.

Referring now to FIGS. 3 and 4, the handle 20 is generally tubular. The handle 20 defines a core 22. The core 22 is configured to receive a threaded rod such as a screw 24 that has a first end 26 with shoulders or a flange 27 that is configured to engage shoulders 31 of the handle 20. Opposite the first end 26 of the screw 24 is a threaded end 28 that is configured to attach to a blade retention mechanism 60.

Figure 5:
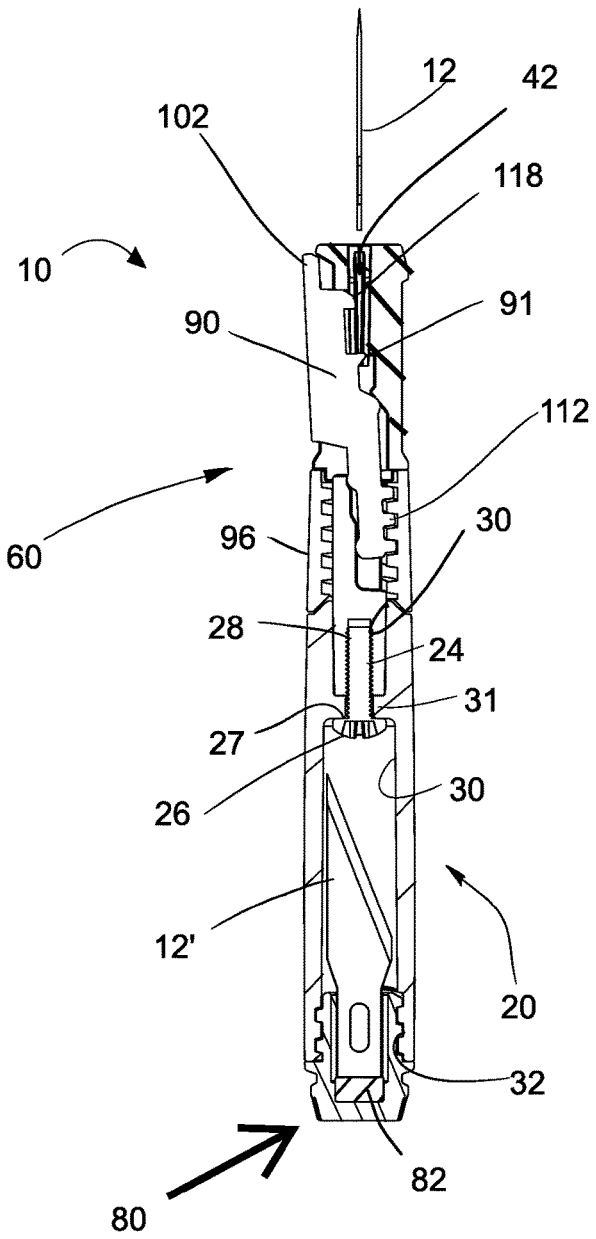
FIG. 5 shows a cross-sectional view of the tool of FIG. 1 taken along line 3-3 with the bit mechanism in a release configuration.

Referring now to FIG. 5, a cavity 30 is defined in the handle. The cavity 30 is generally cup-shaped and has threaded interior walls 32. The threaded interior walls 32 are configured to engage a threaded plug or cap 34. The cap 34 and the interior walls 32 are configured to define a space to receive and retain spare blades 12' or other types of bits. One type of blade 12 to be received in the cavity are craft blades. By way of example and not limitation, suitable blades include: number 11 X-ACTO® brand blades. The blade 12 includes an opening 19 and a base 13.

Figure 6:
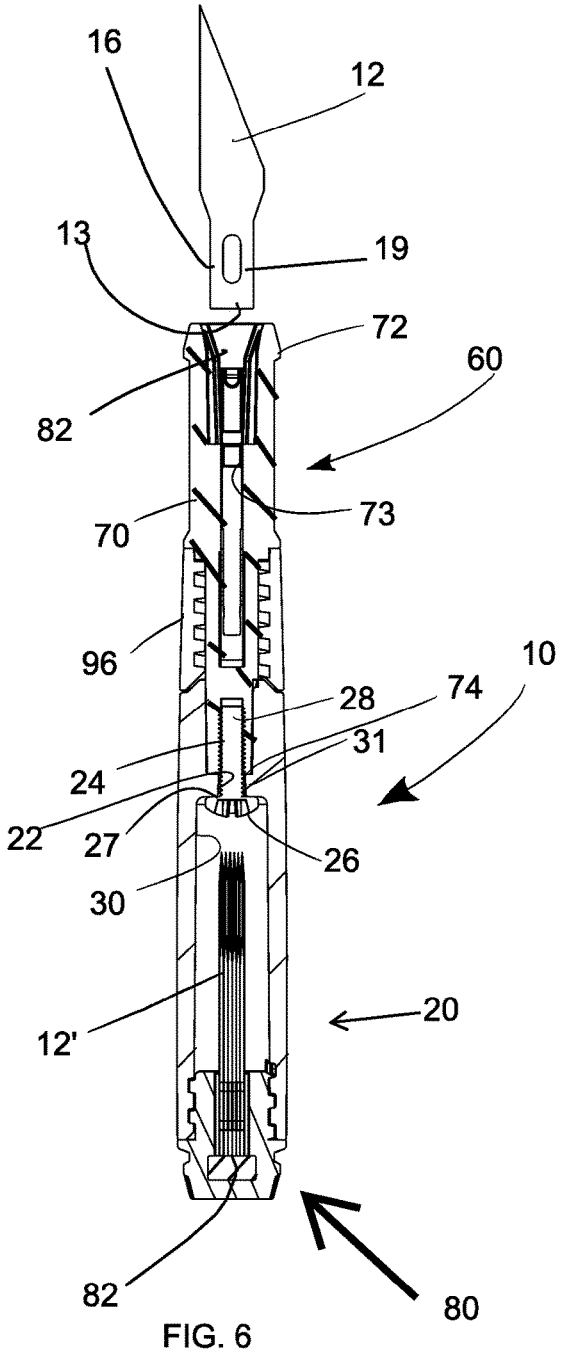
FIG. 6 shows a cross-sectional view of the total of FIG. 2 taken along line 4-4 with the bit mechanism in a release configuration.
Figure 7:
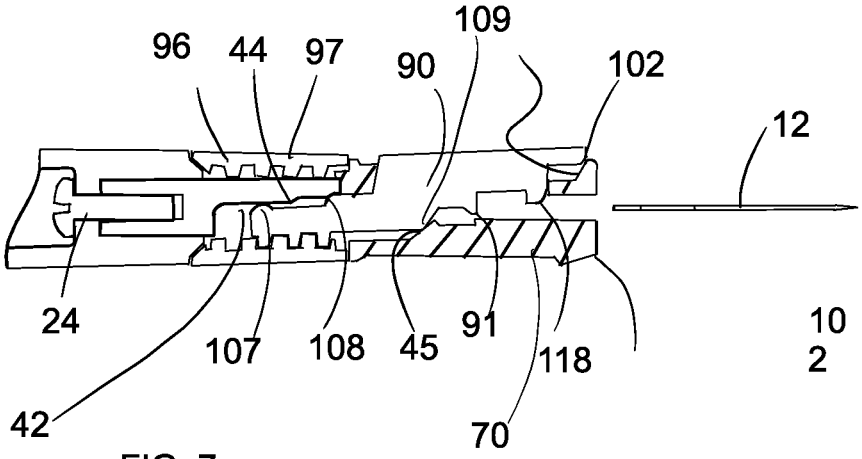
FIG. 7 shows a cross-sectional view of a portion of the tool showing the catch in an open position.
Figure 8:
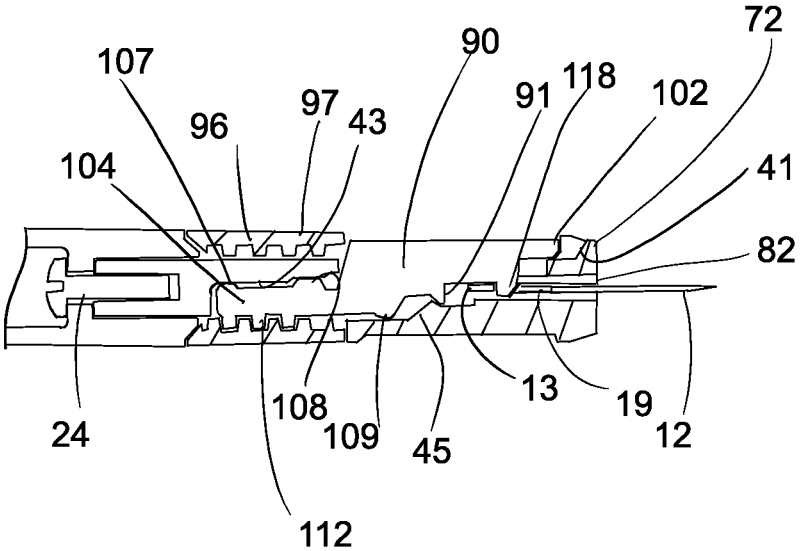
FIG. 8 shows a cross-sectional view of a portion of the tool showing the catch in a closed position.
Figure 10:
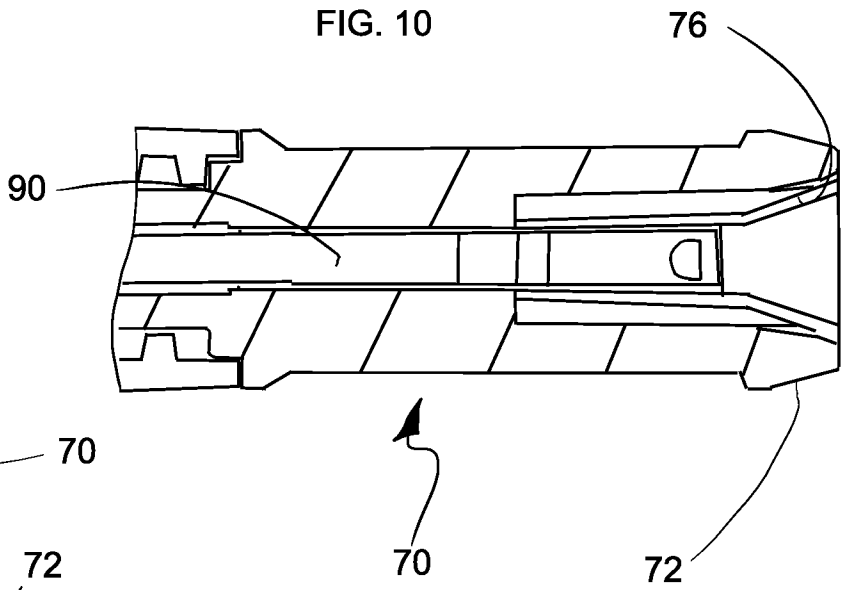
FIG. 10 shows a cross-sectional view of the end of the tool shown in FIG. 9.
Figure 12:
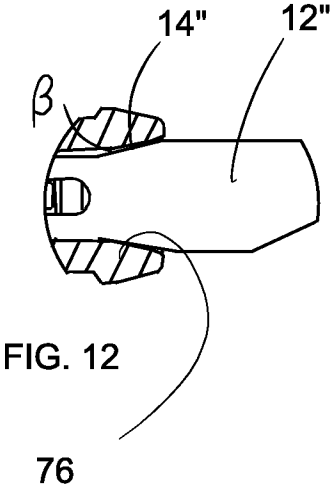
FIG. 12 is taken at circle 12 of FIG. 11 and shows a detailed view of a bit having an optional shoulder configuration inserted into the tool of FIG. 9.
Figure 9:
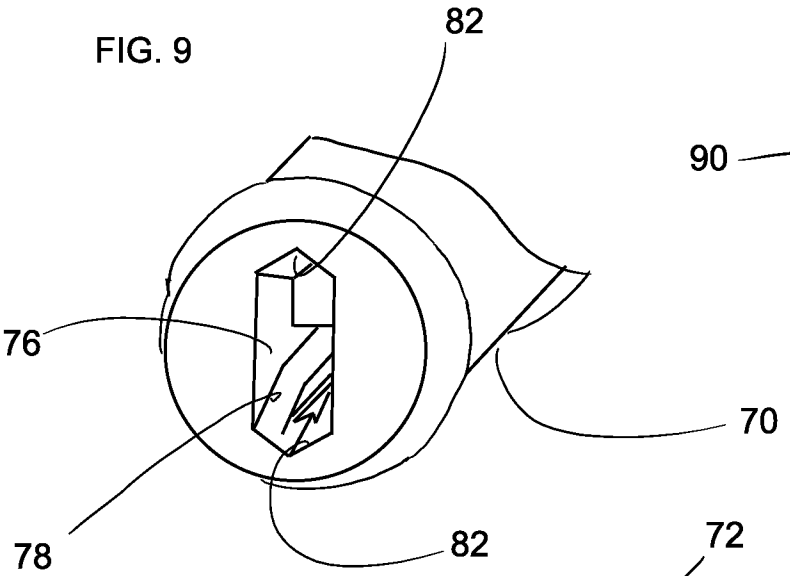
FIG. 9 shows a detailed view of one end of the tool according to the present invention.
Figure 11:
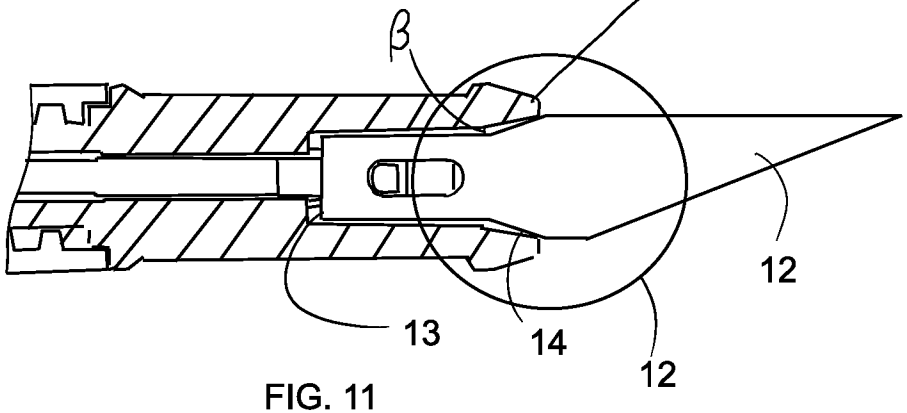
FIG. 11 shows a cross-sectional view of the end of the tool shown in FIG. 9 with a blade inserted therein.
Figure 13:
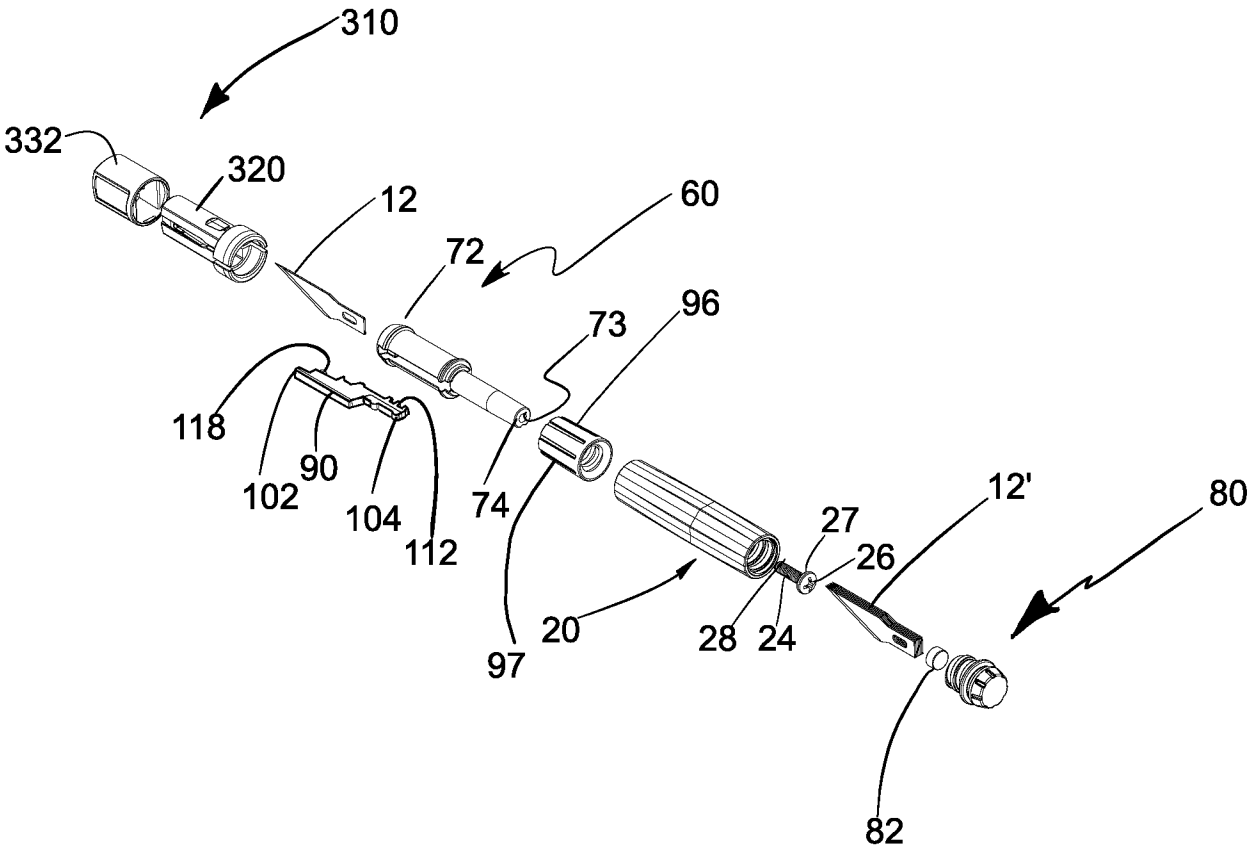
FIG. 13 shows an exploded view of a tool according to the present invention.
Figure 14:
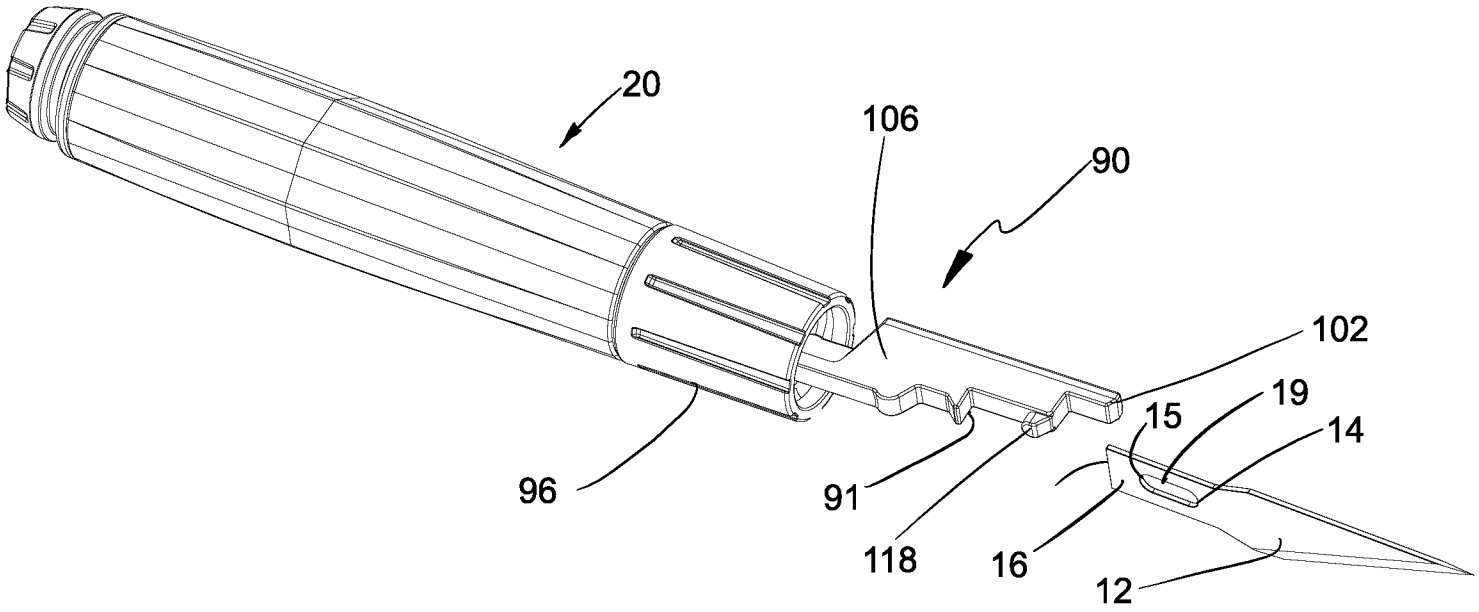
FIG. 14 shows a portion of the retention mechanism and a blade.
Figure 15:
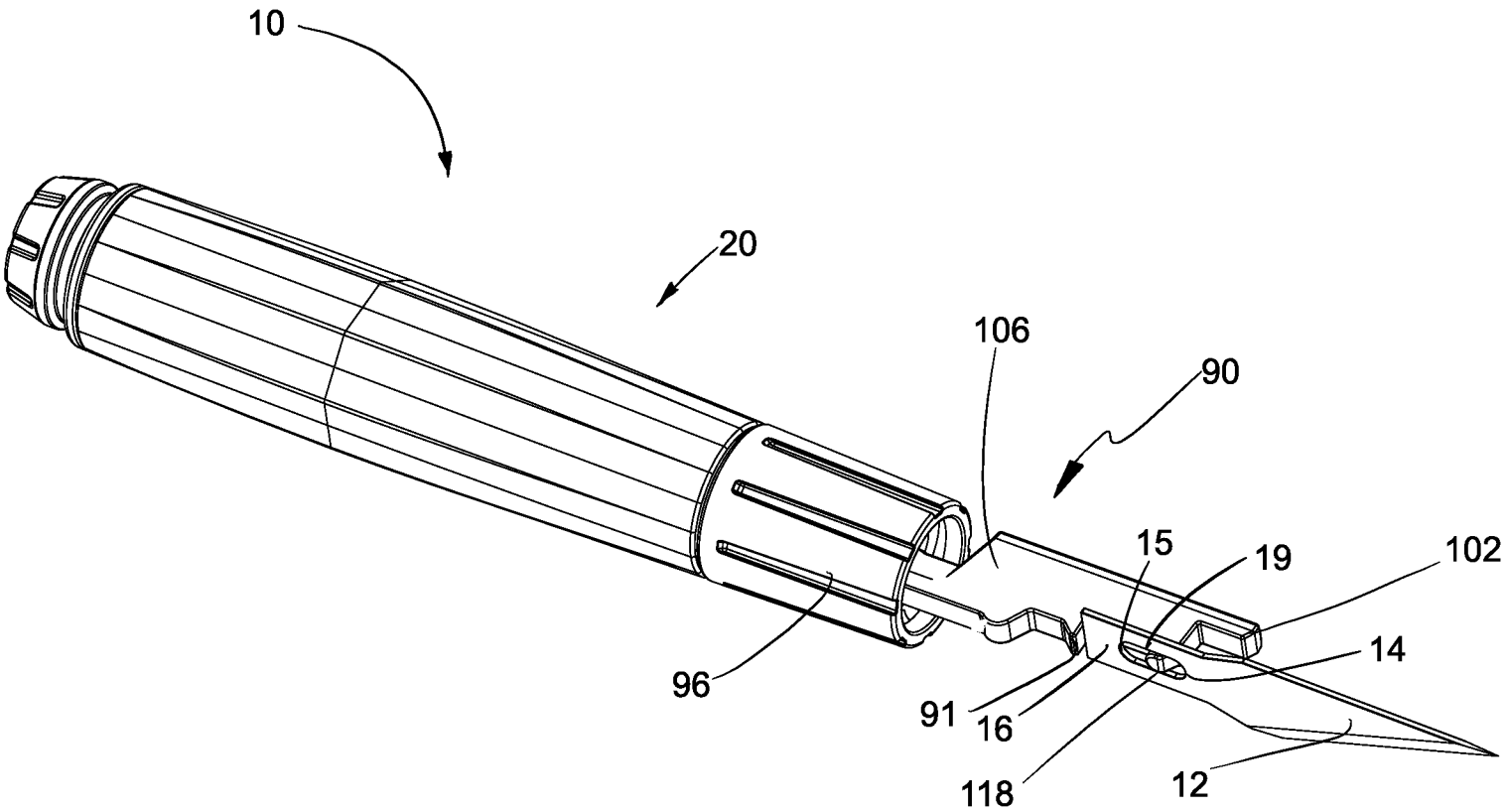
FIG. 15 shows a portion of the retention mechanism and a blade positioned as they would be in a first step of insertion.

Referring now to FIGS. 5-7, the bit retention mechanism 60 includes a body 70, a catch 90, and a knurled nut 96 that is configured to operate as a tightening wheel. The body 70 is generally tubular and defines a channel 73 that extends between a first end 72 and a second end 74. The region of channel 73 near the first end 72 is configured to receive a blade 12. As can be best seen FIGS. 9-11, the body 70 at the first end 72 defines a receptacle 76. The receptacle 76 is defined by inner walls 78. The inner walls 78 are configured such that they form opposing V-shaped grooves 82. The V-shaped grooves 82 of the inner walls 78 are spaced-apart a first distance near the first end 72. The V-shaped grooves 82 are spaced-apart a second distance away from the first end 72. The first distance is greater than the second distance such that the opposite walls 78 are closer together at distances further away from the end of the handle 20. The V-grooves 82 are configured such that shoulders 14 of the blade 12 will rest in the V-grooves 82 as seen in FIG. 11. The shoulders 14 of the blade 12 in FIG. 11 defines an angle β with the inner walls 78. The V-grooves 82 have flared sides that retain the blade 12 and resist side-to-side motion of the blade 12. The V grooves 82 are configured such that they can receive differently configured tools such as different shaped blade 12. For example the blade 12" shown in FIG. 12 is shaped such the shoulders 14" define a different angle β with v-grooves 82 than that shown in FIG. 11.

When the catch 90 is operated such that tension is placed on a shank 16 of the blade 12 by interaction of the hole 19 with the hook 118, the blade 12 fully engages the sides and edges of the blade retention grooves 82. The knurled nut 96 is dimensioned to fit around the base or second end 74 of the body 70. The body 70 is attached to the handle 20 by the screw 24.

The nut 96 is captured between the body 70 and the handle 20. It is generally cylindrical and rotatable about the handle and the second end 74 of the housing. The nut 96 is generally cylindrical and includes an outer surface that is knurled. The outer surface 97 can be smooth or finished with the crosshatch pattern or material to enhance friction.

A guide slot 42 is formed in the body 70 and extends to an end the 41 defined in the first end 72 of the body 70. The guide slot 42 is configured to receive the blade catch 90. The blade is configured to catch and retain the blade 12 in the grooves 82. The blade catch 90 includes a first end 102 that is configured to catch the blade 12 and second end 104 that is configured to engage the nut 96. The catch 90 also includes a body 106. The body 106 defines a blade stop 91 that is configured to contact a base 13 of the blade 12 as the blade 12 is being inserted. The guide slot 42 is configured to define three contact points or guide bumps 107, 108, and 109. The contact points or guide bumps 107, 108, and 109 are positioned such that they contact the guide slot 42 along a guide surface 43. In combination with the shaped guide surface 43 the guide bumps 107, 108, 109 are configured to guide the catch 90 in an L-shaped path. Stated another way, the contact points 107, 108, and 109 in combination with surface 43 are configured to guide the catch 90 in a dogleg path such that when the catch 90 is in the unlocked or open position the end 102 is positioned away from the body 70. As a result, in an unlocked or open position the hook 118 is clear of the V grooves 82 and the blade 12 can be inserted therein. In a closed position the hook 118 securely retains the blade 12 via interaction with the hole 19 in the grooves 82. More specifically, the ramps 44 and 45 defined in the surface 43 interact with the guide bumps 108 and 109 respectively.

At least one tooth 112 is formed in the body 106 near the second end 104. The single at least one tooth 112 is configured to receive a helical thread 114 of the nut 96.

The nut 96 and the catch 90 are configured such that when the nut 96 is rotated in a loosening first direction around the body 70 the catch 90 moves toward the first end 72 of the body 70. When the nut 96 is rotated in tightening second direction the catch 90 moves toward the second end 74 of the body 70. In this manner, the catch 90 can be moved between a tightened position in which the blade is secured in the body and an open position in which the blade is not secured. In the open position, a hook 118 does not engage a hole 19 of the blade 12 and the blade 12 can be removed. In the closed position, the hook 118 does engage the blade 12 and the blade 12 is retained within the body 70.

When the nut 96 is operated to move the catch 90 from the closed position to the open position the end 102 of the catch 90 traces a generally dogleg shaped path as indicated above. Preferably the path traveled by the end 102 is similar to Pennell but not strictly at a right angle. In this regard, the end 102 defines a path that turns preferably at an angle of between about 90 and about 170°, more preferably between an angle of about 120 and about 150° and the most preferably at an angle of about 135°. In addition, it should be noted that when the catch 90 is moved from the closed position to the open position the step 91 engages the base 13 of the blade 12 and asked the transfer of the Ford motion of the catch 90 to the blade 12. This action operates to free the blade 12 from the V grooves 82 in cases where the blade 12 is become jammed from use.

Referring now to FIG. 17 and FIG. 18, there is an embodiment that includes an end cap 80 configured to receive a plurality of spare blades 12' for storage. The end cap 80 is generally cup-shaped and defines a region configured to receive one or more blades 12'. As shown, the blades 12' can be received such that the shanks are within the region of the end cap 80. Optionally, the end cap 80 can be configured such that the tips of the blades 12' are received therein and the shanks extend from it. A magnet 82 is positioned in the base of the end cap 80 for retaining the blades 12' within the end cap 80 (see FIG. 27). Optionally, the magnet can be in the side walls of the end cap 80. The end cap 80 is threaded to engage a handle which is configured to receive the end cap 80.

The end cap 80 includes a magnet 82 that is configured to hold blades 12' in the cap receptacle 81. According to the illustrated embodiment the end cap 80 is configured to threateningly engage the handle 20. The handle 20 is configured to receive the portion of the spare blades 12' that extend from end cap 80.

Figure 16:
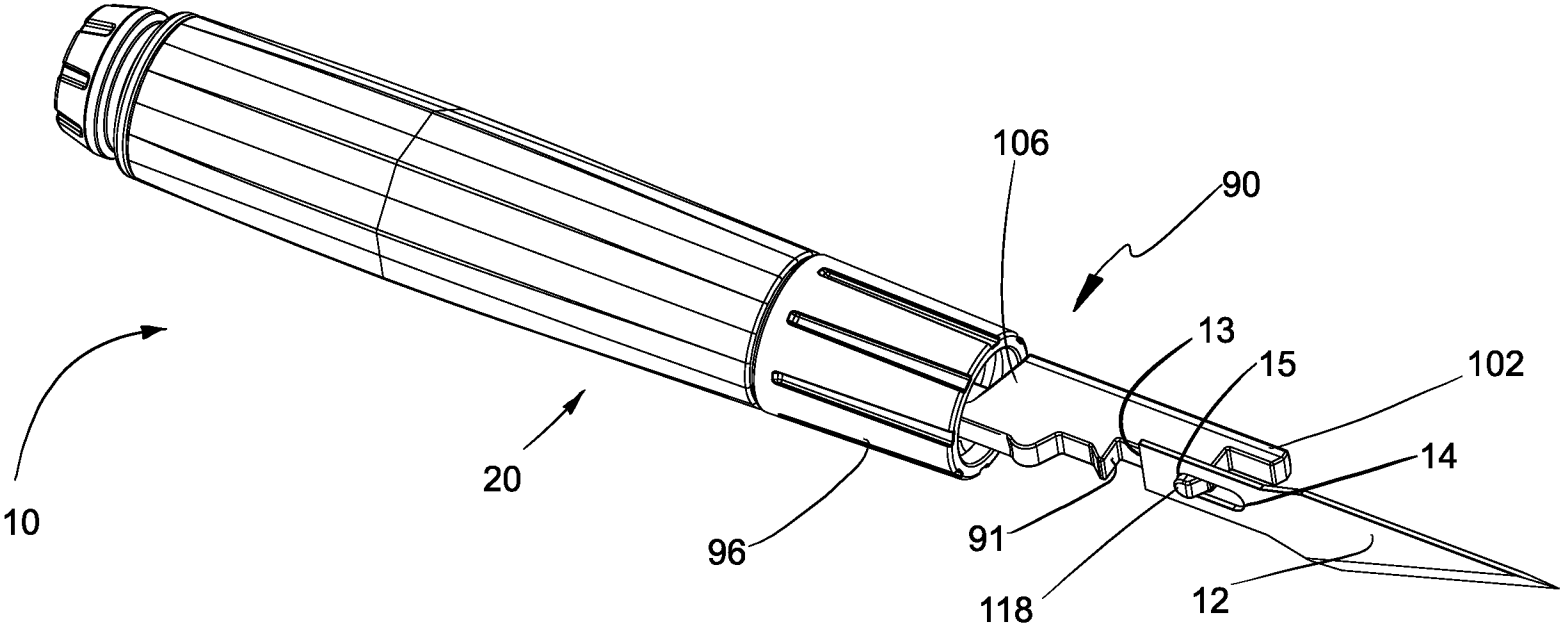
FIG. 16 shows a portion of the retention mechanism and a blade positioned as they would be in a second step of insertion.
Figure 19:
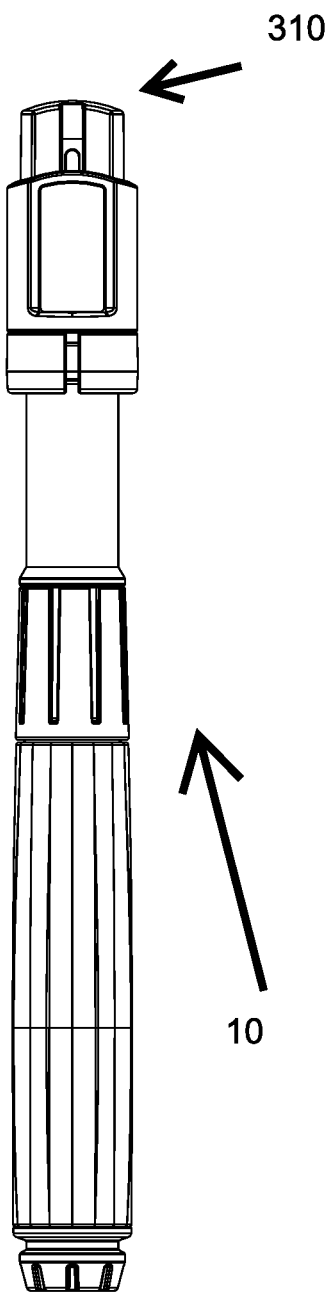
FIG. 19 shows a tool that includes a retention mechanism of the present invention and an end cover in a use position.

Referring now to FIG. 19-23, there is provided a cover 310 that is configured to engage the knife 10 and cover the blade 12. The cover 310 includes a collet 320 that includes an end 322 that is open to a space 324 defined by inner walls of the collet 320. Under cuts that define shoulders 326 are defined within the space 324. A sleeve 332 is provided to confine the collet 320 in a closed position such that it is retained on the knife 10. The sleeve 332 is movable between a closed first position in which the cap can be retained on the knife 10 as shown in FIG. 16 and an open second position as shown in FIG. 19. When the sleeve 332 is in the closed position, the collet 320 is closed. When the sleeve 332 is in the open position, the collet 320 is open. The collet 320 includes a wedge 321 that is configured to extend between two arms 327 and 328 of the collet 320 such that the wedge 321 is operable to cause portions of the arms 327 and 328 to be spaced apart with the sleeve 332 is in the open position.

The collet 320 includes detents 335 that are configured to engage the sleeve 332 such that the sleeve 332 is retained in the closed position. Corresponding barbs 337 and 339 are provided on the sleeve 332 and the collet 320 respectively to retain the sleeve 332 on the collet 320.

Figure 20:
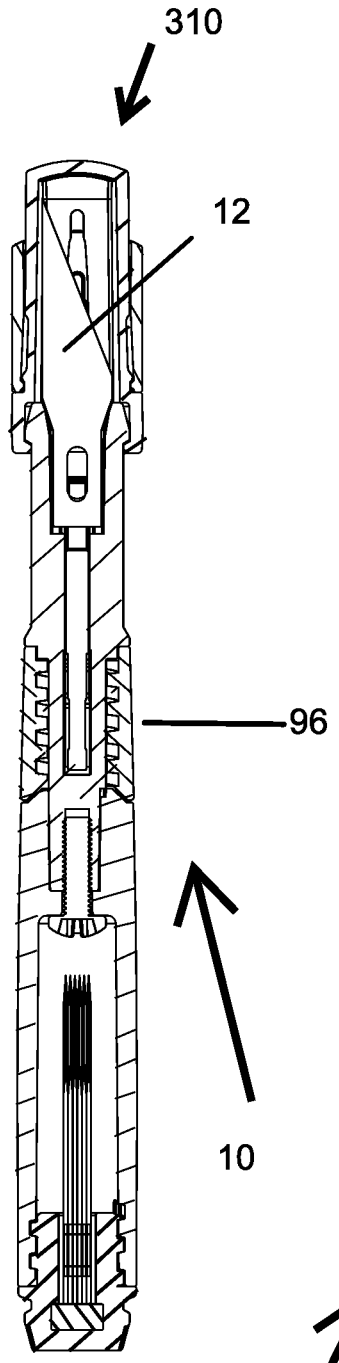
FIG. 20 is a cross-sectional view of the tool FIG. 15.
Figure 21:
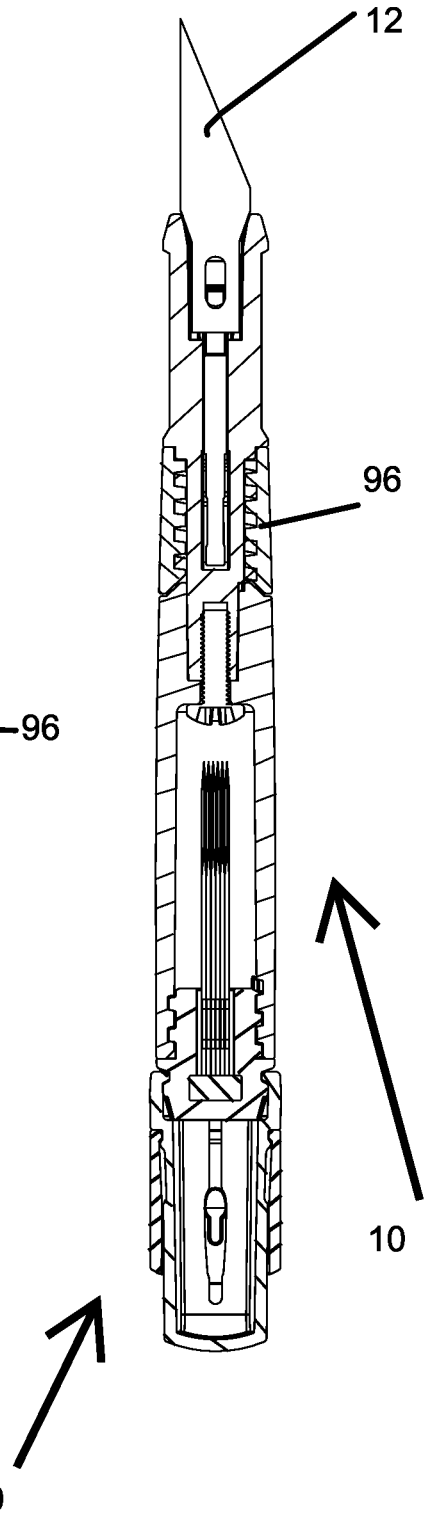
FIG. 21 is a cross-sectional view of the total of FIG. 15 showing the cover in a storage position.
Figure 22:
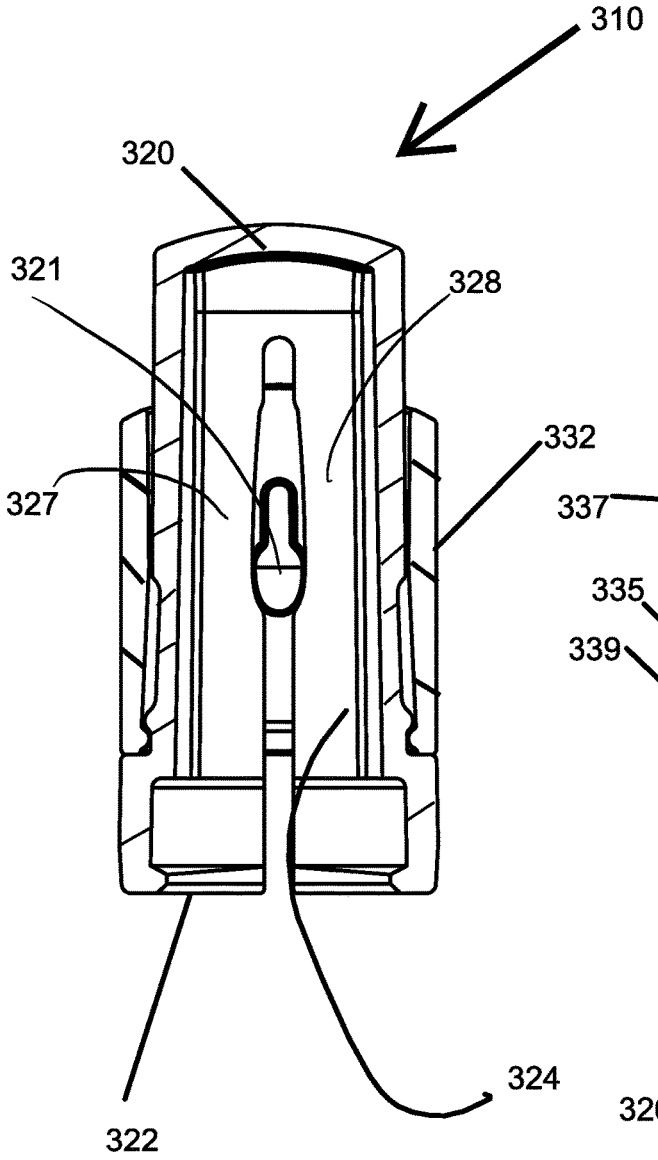
FIG. 22 shows a view of cover according to the present invention in a closed configuration.
Figure 23:
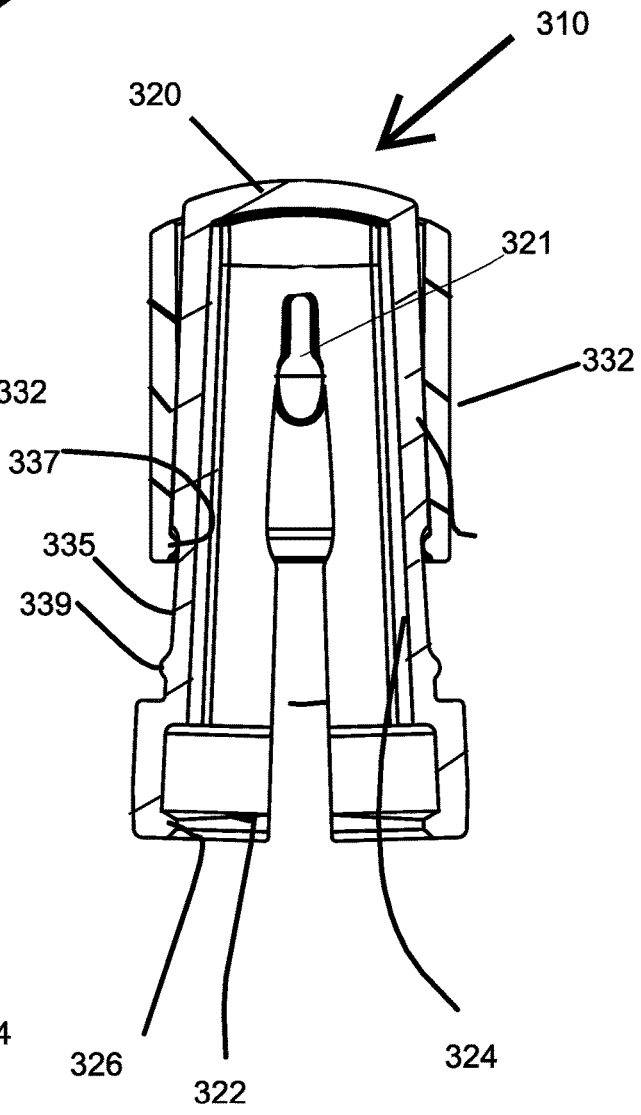
FIG. 23 shows a view of a cover according to the present invention in an open configuration.
Figure 24:
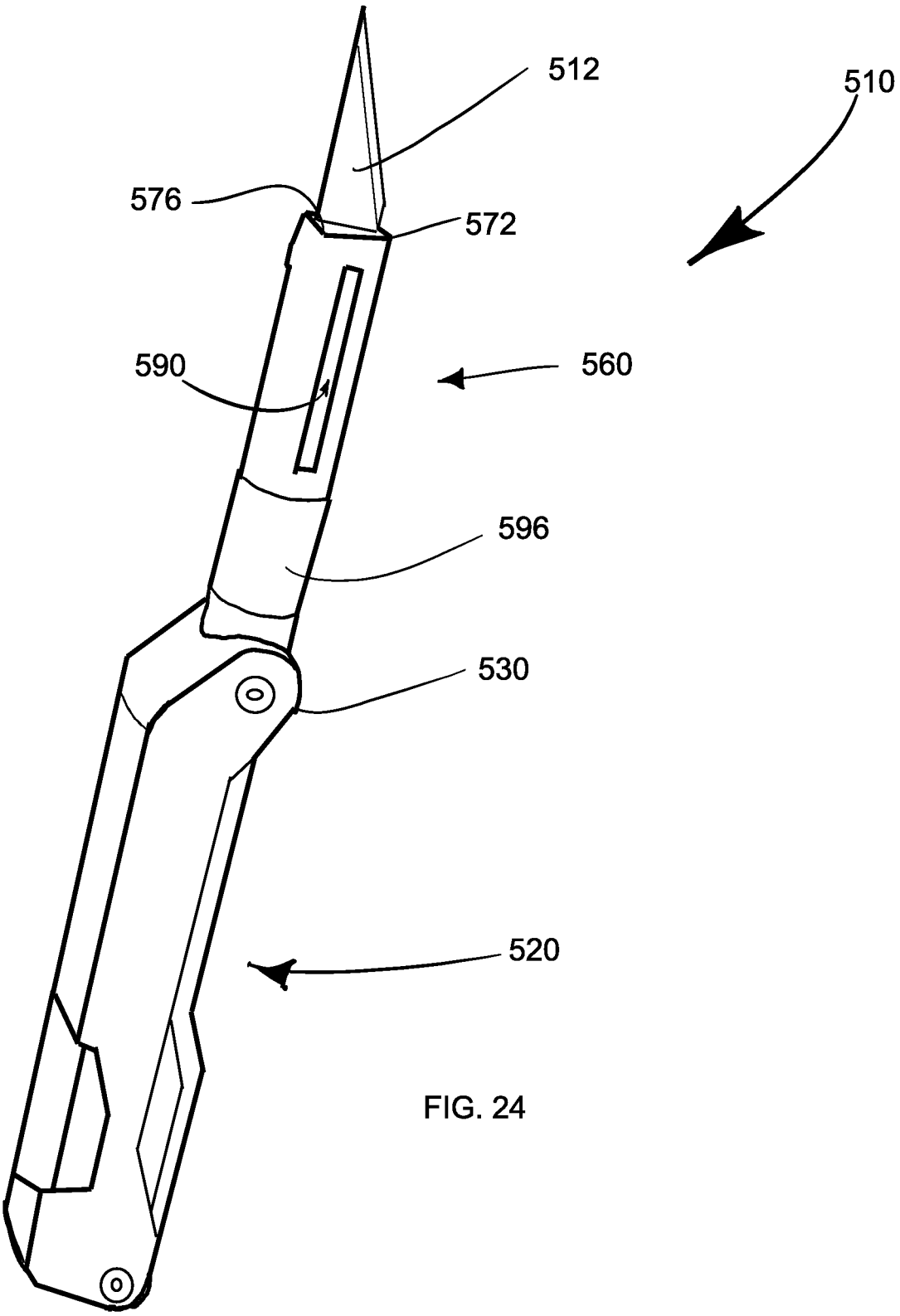
FIG. 24 shows a perspective view of a folding tool according to an alternative embodiment of the present invention.
Figure 25:
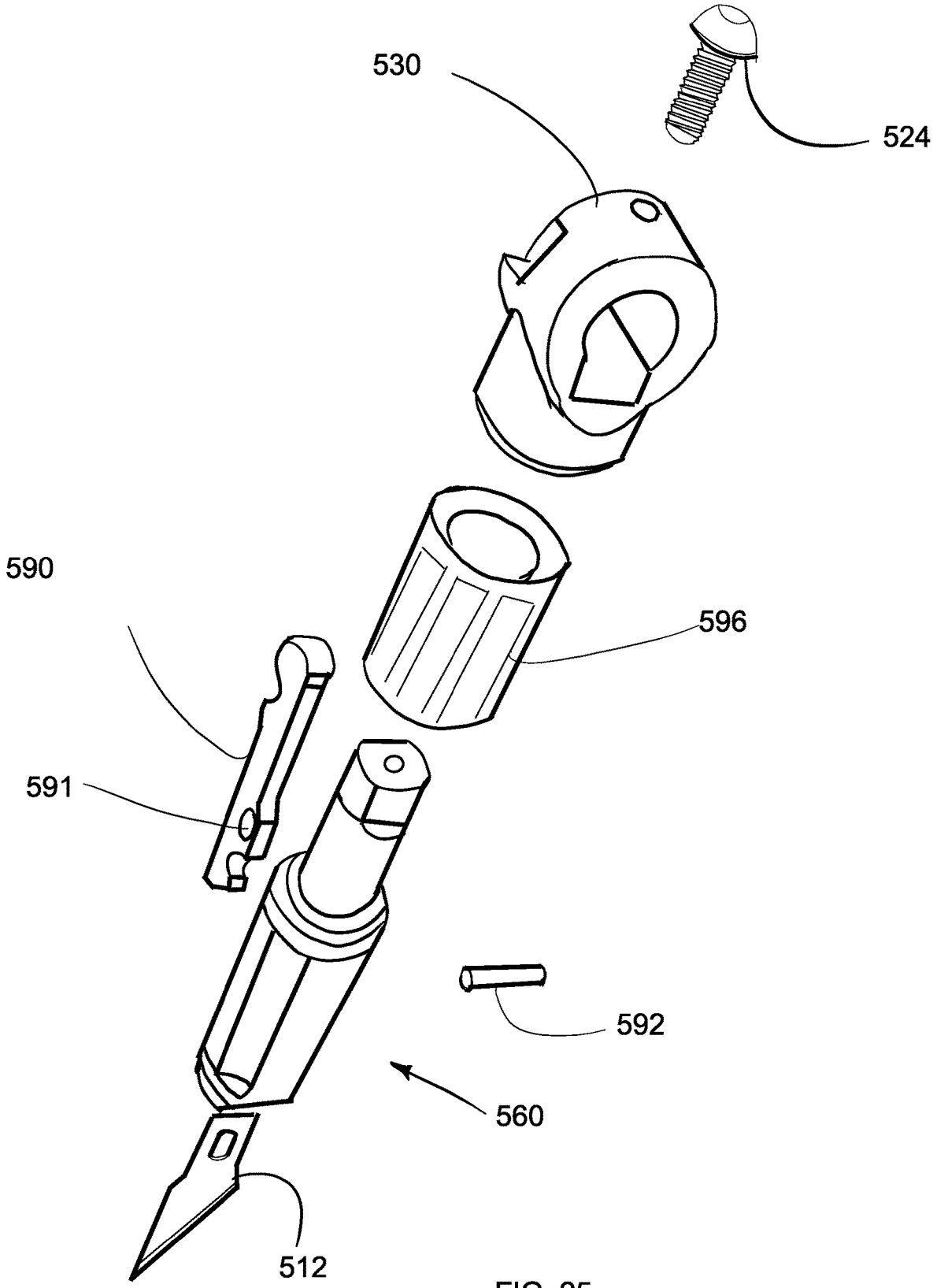
FIG. 25 shows an exploded view of the retention mechanism of the folding tool shown in FIG. 18.
Figure 26:
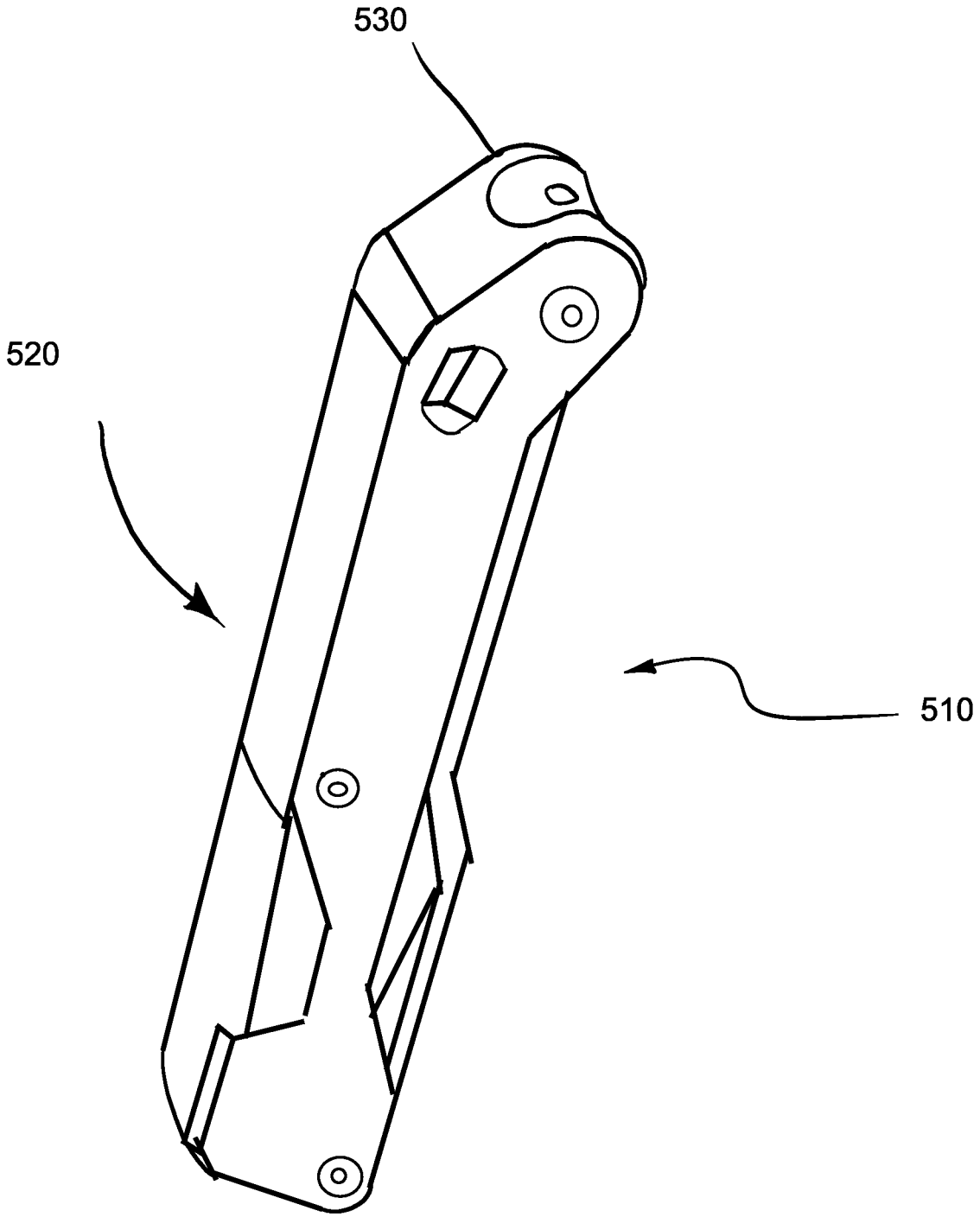
FIG. 26 shows a perspective view of the folding tool of FIG. 18 in the closed configuration.

Referring now to FIG. 19 and FIG. 20 the cover 310 is retained on the tool 10 such that it covers the blade 12. In FIG. 21 knife 10 is shown with the cover 310 retained on the total 10 in a storage position opposite the blade retention mechanism 60. The cover 310 is configured such that the sleeve 332 moves to close the collet 320 when the cover 310 is moved on to the tool 10 by grasping the sleeve 332. In this regard, the cover 310 is self-locking. Similarly, the cover 310 is self-unlocking when the sleeve 332 is grassed moved away from the body of the tool 310 to remove the cover 310.

According to another embodiment as shown in FIG. 18-22, there is provided a tool 510 that is configured to retain a bit or blade 512. The tool 510 includes bit retention mechanism 560 that is connected to a handle portion 520 by a hinge 530. The tool 510 is foldable between an open use position and a closed storage position around the hinge 530 such that the bit retention mechanism 560 is received within the handle 520.

The bit retention mechanism 560 is only accessible when the tool 510 is in the open position. The bit retention mechanism 560 can be understood from the description of the bit retention mechanism 60 above. The bit retention mechanism 560 includes a body 570, a catch 590 configured to receive a guide pin 592 through a hole 591 in a guide configuration that is an alternative to the guide bumps described above with relation to bit retention mechanism 60, and a knurled nut 596 that is configured to operate as a tightening wheel. The body 570 is generally tubular and defines a channel 573 that extends between a first end 572 and a second end 574. The region of channel 573 near the first end 572 is configured to receive a blade 512. In this regard, the body 570 at the first end 572 defines a receptacle 576. The receptacle 576 is defined by inner walls 578. The inner walls 578 are configured such that they form opposing V-shaped grooves 582. The V-shaped grooves 582 of the inner walls 578 are spaced-apart a first distance near the first end 572. The V-shaped grooves 582 are spaced-apart a second distance away from the first end 572. The first distance is greater than the second distance such that the opposite walls 578 are closer together at distances further away from the end of the handle 520. The V-grooves 582 are configured such that shoulders 514 of the blade 512 will rest against the narrower portion of the V-grooves 582. The V-grooves 582 have flared sides that retain the blade 512 and resist side-to-side motion of the blade 512.

According to another embodiment, not shown, there is provided release mechanism that is movable between an insert position and a holding position. When the release mechanism is in the insert position, a blade can be removed or inserted. When the release mechanism is in the holding position, a bit or blade can be retained if previously inserted but cannot be inserted. The blade release mechanism of the tool includes a grip portion that is configured to engage the hole defined on a bit or blade. The release mechanism of tool also includes a release portion. The release portion is configured to ratchet into position with a rack of teeth that is defined on the grip portion. A pawl is attached to the grip portion. The pawl is configured to interact with the enclosure to open and close as needed. When the release mechanism is in the inserting position, the hook is positioned toward the operating end of the tool.

The method and apparatus described herein has several advantages over the prior art. In particular, it eliminates problems associated with tool bits becoming loose during use.

The foregoing has described an apparatus for a bit retention mechanism. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A bit retention mechanism, the mechanism comprising:

a body that includes a first end and a second end;

the body includes an inner wall that defines a channel, and the channel extends between the first end of the body and the second end of the body;

a pair of opposing v-shaped grooves are defined by the inner wall wherein each v-shaped groove has a peak and the peaks are aligned and the pair of opposing grooves are positioned such that near the first end of the body they are spaced-apart a first distance and away from the first end of the body they are spaced-apart a second distance wherein the second distance is shorter than the first distance;

the grooves are configured to receive a bit;

the body defines a guide slot that extends from the first end of the body to a position between the first end of the body and the second end of the body;

the guide slot is configured to receive a catch;

the catch includes a first catch end configured to retain a bit such that the bit can be received by the pair of opposing grooves;

the catch is movable between a tightened position and an open position along a path;

in the tightened position, the catch is configured such that a blade can be retained such that it cannot be removed from within the body of the retention mechanism; and in the open position, the catch is configured such that the blade can be removed or inserted into the body of the retention mechanism.

2. The bit retention mechanism according to claim 1, wherein the V-shaped grooves are configured to receive shoulders of the bit.

3. The bit retention mechanism according to claim 2, wherein the V-shaped grooves include flared sides that are configured to retain the bit and to resist side-to-side motion of the bit.

4. The bit retention mechanism according to claim 3, wherein a nut is positioned on the body such that it is movably engaged with the catch and the catch also includes a catch-body that defines a blade stop.

5. The bit retention mechanism according to claim 1, wherein the path is defined by guide bumps formed on the catch in combination with a shape of the guide slot.

6. The bit retention mechanism according to claim 5, wherein the path is L-shaped.

7. A blade retention mechanism, the mechanism comprising:

a body;

a catch configured to engage a bit;

a knurled nut configured to engage the catch and movable such that the catch is moved between a first position and a second position; and a receptacle defined at least in part by a first wall and a second wall;

the first wall and the second wall each define a v-groove formed in the body configured to receive and retain a bit when the catch is in the first position;

the receptacle having a greatest width that is defined by an apex of each of the v-grooves;

the first wall extending from a first position near the first end to a second position away from the first end;

the first wall and the second wall are spaced-apart a first distance at the first position near the first end and the first wall and the second wall are spaced-apart a second distance at the second position away from the first end; and wherein the first distance is greater than the second distance.

8. The bit retention mechanism according to claim 7, wherein the V-shaped grooves include flared sides that are configured to retain the bit and to resist side-to-side motion of the bit.

9. The bit retention mechanism according to claim 8, wherein a nut is positioned on the body such that it is movably engaged with the catch and the catch also includes a catch-body that defines a blade stop.

10. The bit retention mechanism according to claim 7, comprising:

a tensioning device that is movable between a first position and a second position such that when the tensioning device is in the first position and is engaged with the bit, the bit is secured within a body and when the tensioning device is in the second position the bit can be removed from the body.

11. A blade retention mechanism, the mechanism comprising:

a body;

a catch configured to engage a bit;

a knurled nut configured to engage the catch and movable such that the catch is moved between a first position and a second position; and a receptacle extending into the body away from a first end of the body and defining an opening at the first end of the body that is configured to receive a bit and the opening is defined by opposing v-shaped walls wherein each has a peak and the peaks are aligned;

the receptacle is configured to receive and retain a bit when the catch is in the first position; and wherein the receptacle is wider near the first end and the receptacle is narrower at a point that is spaced-away from the first end.

12. The bit retention mechanism according to claim 11, comprising:

a tensioning device that is movable between a first position and a second position such that when the tensioning device is in the first position and is engaged with the bit, the bit is secured within a body and when the tensioning device is in the second position the bit can be removed from the body.

* * * * *